US011751727B1

(12) United States Patent
Ndiaye

(10) Patent No.: US 11,751,727 B1
(45) Date of Patent: Sep. 12, 2023

(54) RELIGIOUS PURIFICATION APPARATUS

(71) Applicant: Mbaye Ndiaye, New York, NY (US)

(72) Inventor: Mbaye Ndiaye, New York, NY (US)

( * ) Notice: Subject to any disclaimer, the term of this patent is extended or adjusted under 35 U.S.C. 154(b) by 0 days.

(21) Appl. No.: 17/865,150

(22) Filed: Jul. 14, 2022

(51) Int. Cl.
*A47K 3/022* (2006.01)
*A47K 3/12* (2006.01)

(52) U.S. Cl.
CPC ..... *A47K 3/022* (2013.01); *A47K 3/122* (2013.01)

(58) Field of Classification Search
CPC ..... A47K 3/022; A47K 3/062; A47K 3/125; A47K 3/12; A47K 3/122; A47G 33/02; A47G 33/00; A61H 35/006
See application file for complete search history.

(56) References Cited

U.S. PATENT DOCUMENTS 335,838 A * 2/1886 Perkins ..... A61H 35/006 4/622
3,283,756 A * 11/1966 Turley ..... A61H 35/006 601/166
3,925,830 A * 12/1975 Delaney ..... A47K 3/022 4/615
D287,075 S * 12/1986 Colin ..... D6/349
4,912,786 A * 4/1990 Wheelock ..... A47K 3/022 220/555
5,579,545 A * 12/1996 Beard ..... A47K 3/125 4/574.1
5,640,723 A * 6/1997 Stanek ..... A47K 3/282 297/188.1
6,931,675 B1 * 8/2005 Hager ..... A47K 3/022 4/622
10,682,019 B2 * 6/2020 Streen ..... B65D 75/5866
2013/0055500 A1 * 3/2013 Fakhro ..... A61H 35/006 4/639
2020/0260915 A1 * 8/2020 Rozilawati ..... E03C 1/04

* cited by examiner

*Primary Examiner* — Erin Deery

(57) ABSTRACT

A religious purification apparatus suitable for practicing Wudhu at any suitable location is presented. The religious purification apparatus contains a reservoir housing, a cap body, a stool body, and a connection element. The reservoir housing contains a reservoir brim, a reservoir base, a reservoir cavity, a reservoir platform, and a holding platform. The cap body contains a stool receiving aperture, and a reservoir receiver. The reservoir cavity traverses from the reservoir brim to the reservoir base. The reservoir platform is positioned within the reservoir cavity. The holding platform is positioned within the reservoir cavity. The holding platform is connected along the reservoir brim. The reservoir receiver traverses along the cap body. The stool receiving aperture traverses through the cap body. The reservoir receiver is removably connected along the reservoir brim through the connection element. The stool body is positioned within the stool receiving aperture.

11 Claims, 5 Drawing Sheets

RELIGIOUS PURIFICATION APPARATUS

FIELD OF THE INVENTION

The present invention relates generally to a religion specific praying tool. More specifically, the present invention is a Muslim praying kit that provides easy access, allowing the practitioner to pray at any location he/she wishes.

BACKGROUND OF THE INVENTION

Wu ū'ḍ (or Wudu/Wudhu) is the Islamic procedure for cleansing parts of the body, a type of ritual purification, or ablution. The 4 Fardh (Mandatory) acts of Wudu consists of washing the face, arms, then wiping the head and the feet with water. Wudu is an important part of ritual purity in Islam. It is governed by fiqh (Islamic jurisprudence), which specifies rules concerning hygiene and defines the rituals that constitute it. In conventional systems, fixed Wudu stations are oftentimes emplaced in relevant sites such as, but not limited to mosques, households, workplace buildings, or any other suitable site to practice Wudu. Since Wudu is practiced five times a day, practitioners may wind up in a situation where a Wudu station is unavailable. Therefore, it is an object of the present invention to make it easy to perform such purification in any location the practitioner wishes.

The present invention aims to solve these problems. The present invention provides a portable and compact station appropriate for practicing Wudu. Approximately 1.5 billion Muslims around the world may need the present invention for their daily prayers. The present invention could be sold at a wide variety of hardware stores, supply stores, container stores, etc.

SUMMARY OF THE INVENTION

The present invention is a religious purification apparatus suitable for practicing Wudhu at any suitable location. The religious purification apparatus comprises a reservoir housing, a cap body, a stool body, and a connection element. The reservoir housing comprises a reservoir brim, a reservoir base, a reservoir cavity, a reservoir platform, and a holding platform. The cap body comprises a stool receiving aperture, and a reservoir receiver. The reservoir brim and the reservoir base are terminally positioned opposite to each other along the reservoir housing. The reservoir cavity traverses from the reservoir brim to the reservoir base. The reservoir platform is positioned within the reservoir cavity. The reservoir platform is connected along the reservoir base, opposite to the reservoir brim. The holding platform is positioned within the reservoir cavity. The holding platform is connected along the reservoir brim. The reservoir receiver traverses along the cap body. The stool receiving aperture traverses through the cap body. The reservoir receiver is removably connected along the reservoir brim through the connection element. The stool body is positioned within the stool receiving aperture, where the stool body is configured to seat within the reservoir cavity of the reservoir housing in a retracted configuration.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

Figure 1:
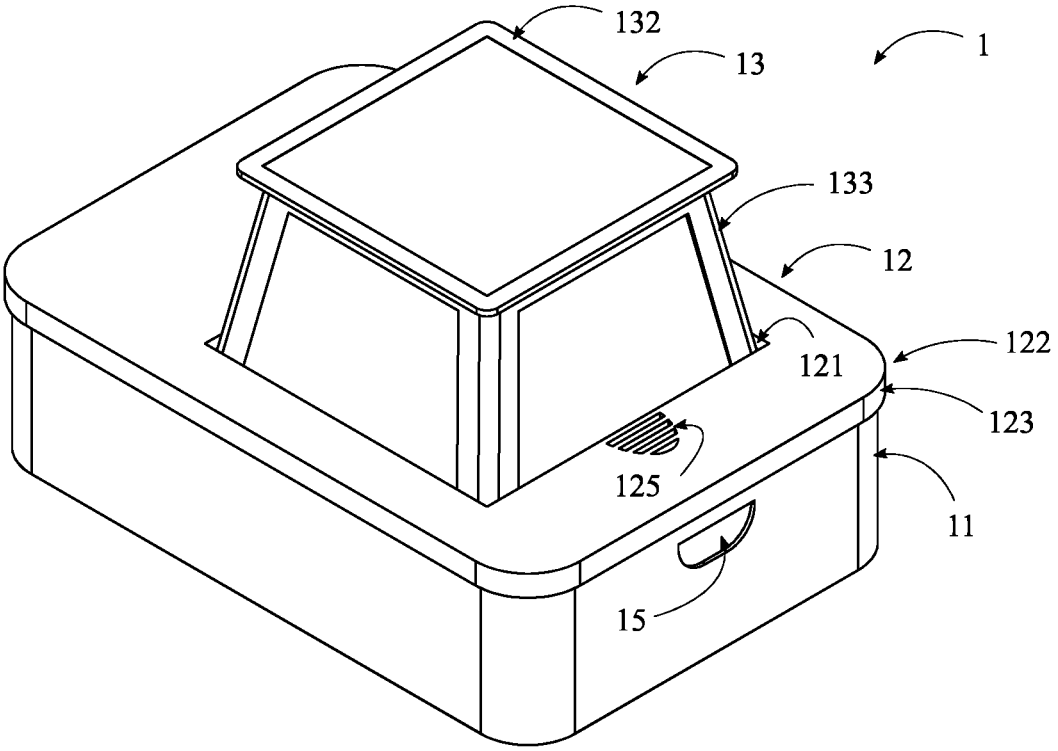
FIG. 1 is a top perspective view of the present invention in accordance with a retracted configuration.

In reference to FIGS. 1-4, the present invention is a religious purification apparatus 1 suitable for practicing Wudhu at any suitable location. The religious purification apparatus 1 comprises a reservoir housing 11, a cap body 12, a stool body 13, and a connection element 14. The reservoir housing 11 comprises a reservoir brim 111, a reservoir base 112, a reservoir cavity 113, a reservoir platform 114, and a holding platform 115. The cap body 12 comprises a stool receiving aperture 121, and a reservoir receiver 122. The reservoir brim 111 and the reservoir base 112 are terminally positioned opposite to each other along the reservoir housing 11. The reservoir cavity 113 traverses from the reservoir brim 111 to the reservoir base 112. The reservoir platform 114 is positioned within the reservoir cavity 113. The reservoir platform 114 is connected along the reservoir base 112, opposite to the reservoir brim 111. The holding platform 115 is positioned within the reservoir cavity 113. The holding platform 115 is connected along the reservoir brim 111. The reservoir receiver 122 traverses along the cap body 12. The stool receiving aperture 121 traverses through the cap body 12. The reservoir receiver 122 is removably connected along the reservoir brim 111 through the connection element The stool body 13 is positioned within the stool receiving aperture 121, where the stool body 13 is configured to seat within the reservoir cavity 113 of the reservoir housing 11 in a retracted configuration, as shown in FIG. 1.

Figure 2:
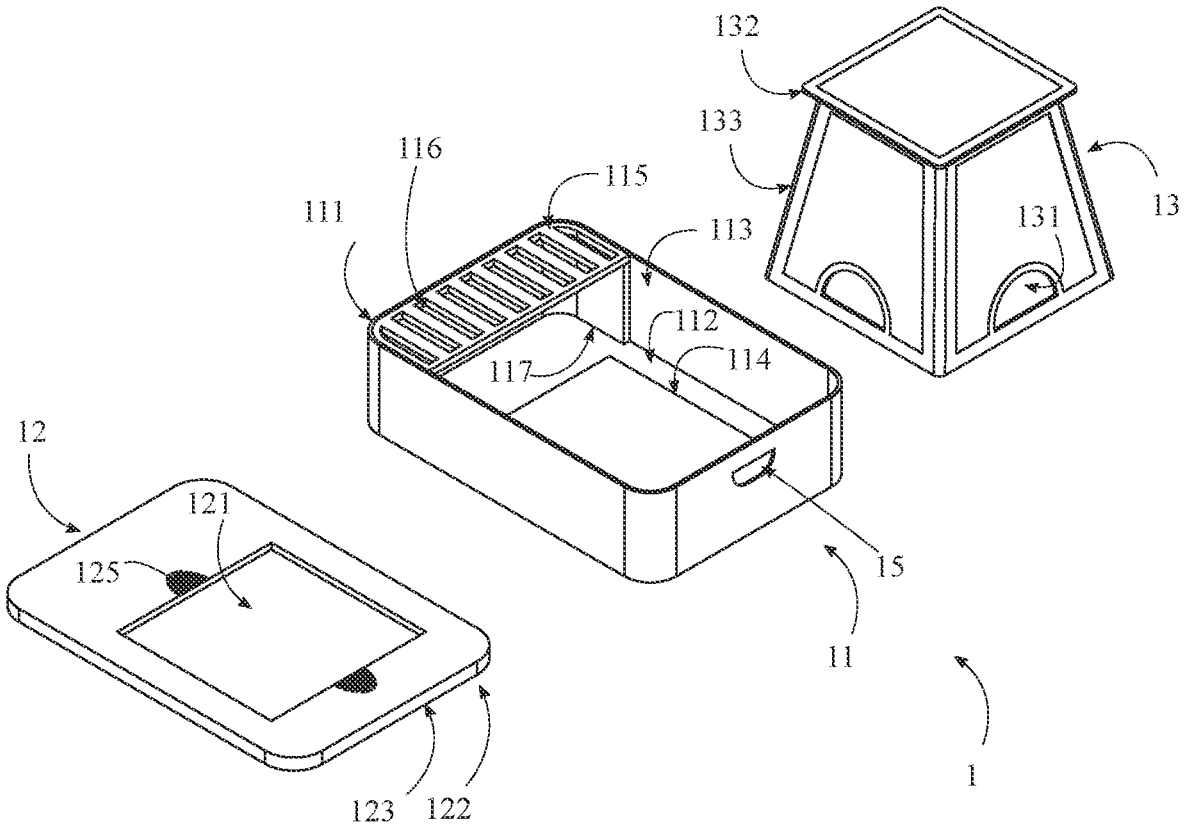
FIG. 2 is a top perspective view of the present invention in accordance with a deployed configuration.
Figure 3:
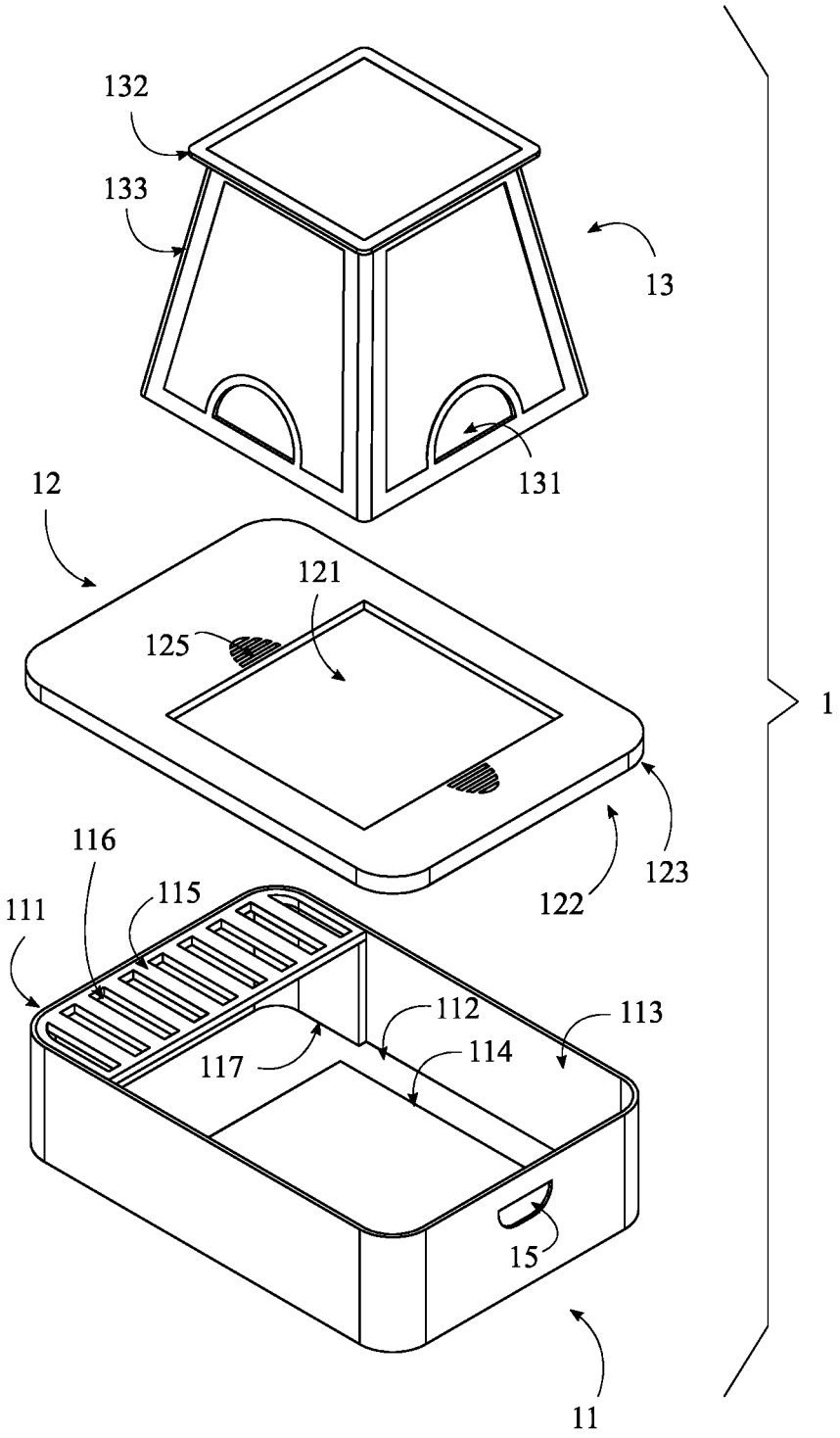
FIG. 3 is a top perspective exploded view of the present invention.
Figure 4:
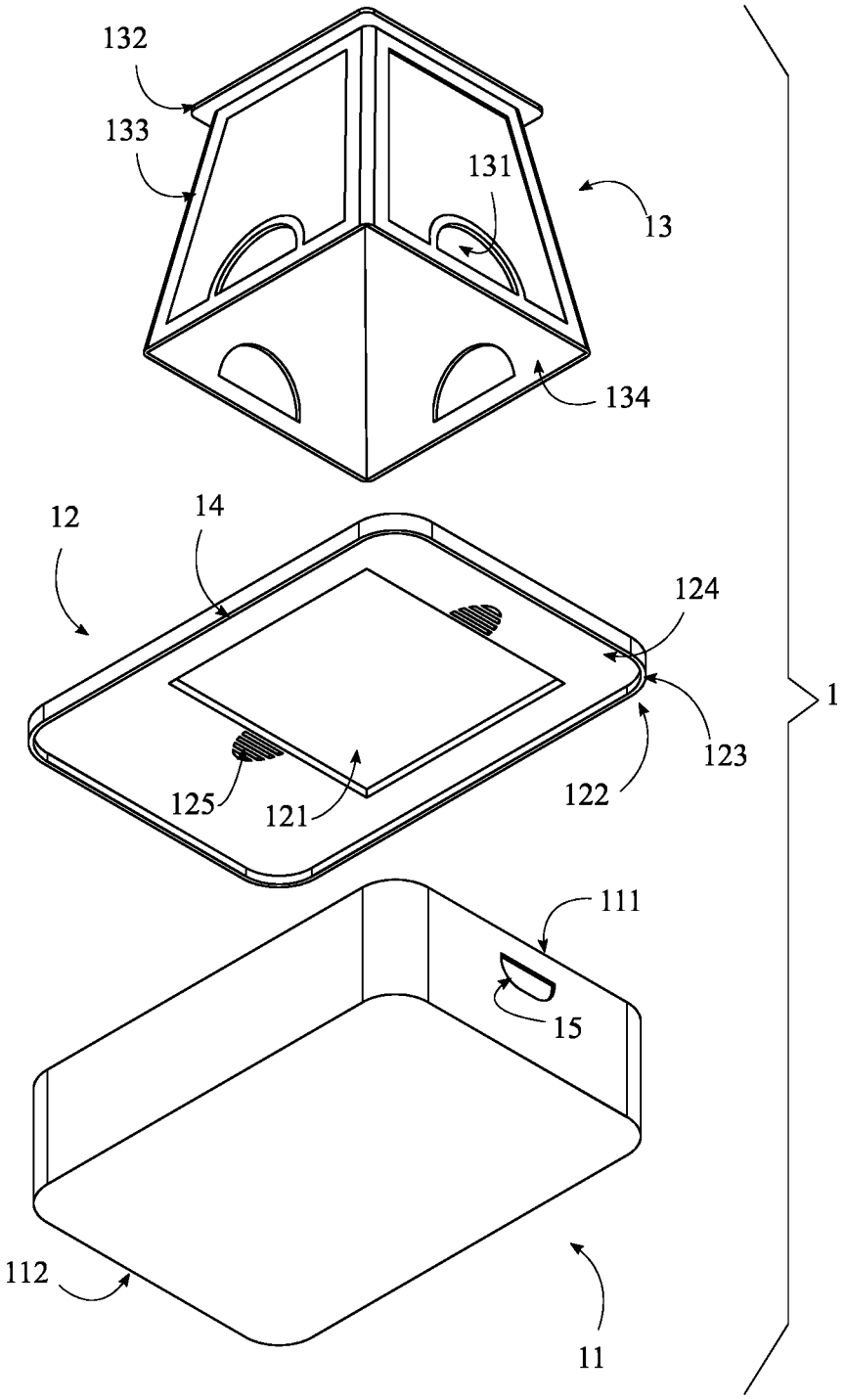
FIG. 4 is a bottom perspective exploded view of the present invention.
Figure 5:
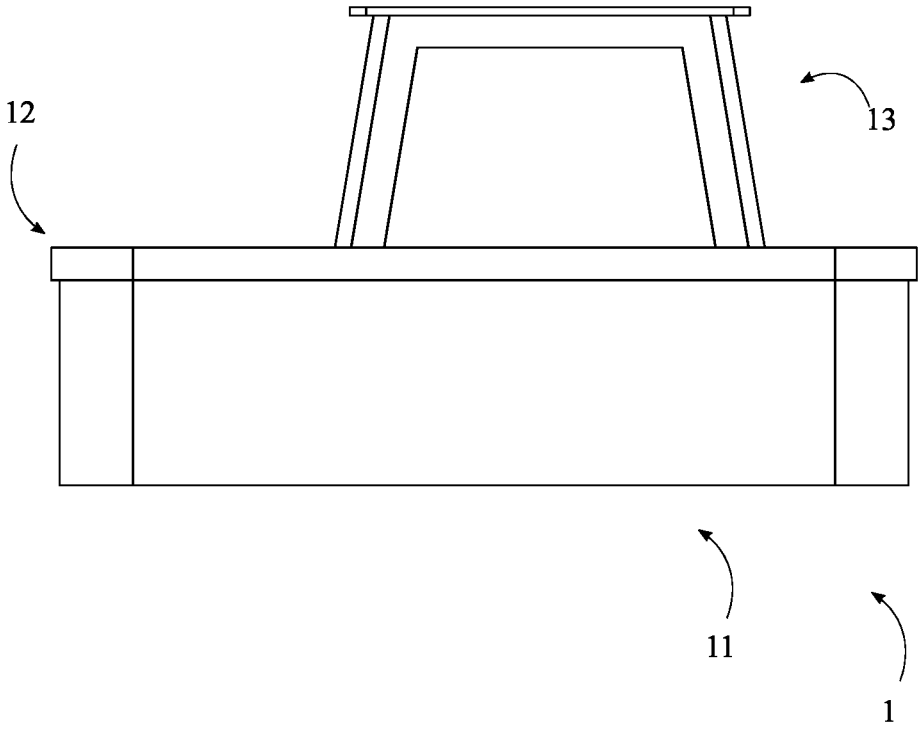
FIG. 5 is a front view of the present invention.

In the preferred embodiment, the connection element 14 is a magnet style connector, wherein the magnet style connector is configured to hold and secure the cap body 12 along the reservoir brim 111. In various embodiment, the connection element 14 may take the form of any other suitable connection implement, such as, but not limited to clip fasteners, lock style fasteners, buckles or any other suitable connection implement. In the preferred embodiment, the reservoir housing 11 takes the form of any suitable housing implement that holds and secures the components the constitutes the religious purification apparatus 1. Furthermore, the reservoir housing 11 takes the form of a reservoir basin that collects and holds wash water used during the Wudhu ritual for later disposal. In the preferred embodiment, the cap body 12 takes the form of any suitable cap implement that covers the reservoir housing 11 when not in use. More specifically, the cap body 12 holds and secures the stool body 13 along the reservoir housing 11 in the retracted configuration, as shown in FIG. 1. In the deployed configuration, as shown in FIG. 2, the cap body 12 is removed to expose the reservoir cavity 113 for Wudhu use.

In the preferred embodiment, the stool body 13 takes the form of any suitable seating element that installs along the stool receiving aperture 121 in the retracted configuration, as shown in FIG. 1. The stool body 13 serves as a seating implement suitable for Wudhu practicing. In the preferred embodiment, the components that constitutes the religious purification apparatus 1 is made out of any suitable material, such as, but not limited to high strength polymers, aluminum, treated wood, or any other suitable material. In the preferred embodiment, the reservoir brim 111 takes the form of the upper perimeter brim of the reservoir housing 11 that connects the cap body 12. In the preferred embodiment, the reservoir base 112 takes the form of the bottom layer of the reservoir housing 11. In the preferred embodiment, the reservoir cavity 113 serves as a reservoir basin, formed in conjunction with the reservoir brim 111 and the reservoir base In the preferred embodiment, the reservoir platform 114 serves as a raised platform implement projecting from the reservoir base 112 towards the reservoir brim 111. The reservoir platform 114 serves as a footrest, allowing the practitioner to place their feet on the reservoir platform 114 such that wash water drips down the reservoir platform 114 during washing. In the preferred embodiment, the holding platform 115 serves as any suitable holding platform 115 that holds a wash water receptacle (not shown) along the reservoir housing 11, providing the user easy access and storage of the wash water receptacle during Wudhu. The stool receiving aperture 121 serves as a mounting implement for the stool body 13, where the stool receiving aperture 121 is configured to positioned and nest the stool body 13 within the reservoir cavity 113 in the retracted configuration, as shown in FIG. 1. In the preferred embodiment, the reservoir receiver 122 takes the form of any suitable receiving element to install the cap body 12 along the reservoir brim 111 of the reservoir housing 11.

The reservoir housing 11 further comprises a mounting element 117. The mounting element 117 partially traverses from the reservoir base 112 to the reservoir brim 111. The holding platform 115 is connected along the mounting element 117. In the preferred embodiment, the mounting element 117 takes the form of any suitable mounting implement that mounts the holding platform 115 along the reservoir housing In the preferred embodiment, the mounting element 117 takes the form of a raised step that holds and secures the holding platform 115 along the reservoir housing 11. The holding platform 115 comprises a plurality of drainage slots 116. The plurality of drainage slots 116 is distributed about the holding platform 115. In the preferred embodiment, the plurality of drainage slots 116 takes the form of drainage implements that allow any trace amounts of wash water dripping from the wash water receptacle to permeate through the holding platform 115.

The stool body 13 comprises a plurality of first handling apertures 131. The plurality of first handling aperture is distributed about the stool body 13. In the preferred embodiment, the plurality of first handling apertures 131 takes the form of handling slots that allows the practitioner to grasp and handle the stool body 13. The cap body 12 comprises a plurality of second handling apertures 125. The plurality of second handling apertures 125 is perimetrically distributed about the stool receiving aperture 121. In the preferred embodiment, the plurality of second handling apertures 125 takes the form of handling apertures that allows the practitioner to grasp and handle the cap body 12.

The stool body 13 comprises a seating platform 132, and a stool base 133. The seating platform 132 is connected adjacent to the stool base 133. The stool base 133 is positioned within the stool receiving aperture 121, where the stool body 13 is configured to seat within the reservoir cavity 113 of the reservoir housing 11 in a retracted configuration, as shown in FIG. 1. In reference to FIG. 4, the stool body 13 further comprises a platform receiver 134. The platform receiver 134 traverses into the stool base 133, where the platform receiver 134 is configured to nest along the reservoir platform 114 in a retracted configuration, as shown in FIG. 1. In the preferred embodiment, the seating platform 132 takes the form of any suitable seating element that the practitioner directly sits along. In the preferred embodiment, the stool base 133 takes the form of any suitable stool base 133 that raises the seating platform 132 off the flat surface the stool body 13 is positioned along. In the preferred embodiment, the platform receiver 134 takes the form of a receiving implement that nests the seating base along the reservoir platform 114 in the retracted configuration, as shown in FIG. 1.

The reservoir receiver 122 comprises and a receiving skirt 123. The receiving skirt 123 is perimetrically connected along the cap body 12. The reservoir receiver 122 further comprises a reservoir receiving cavity 124. The reservoir receiving cavity 124 partially traverses into the receiver skirt, where the reservoir receiving cavity 124 nests along the reservoir brim 111 in the retracted configuration, as shown in FIG. 1. The receiving skirt 123 takes the form of a raise partition perimetrically positioned along the cap body 12 that nests along the reservoir brim 111 of the reservoir housing 11. In the preferred embodiment, the reservoir receiving cavity 124 takes the form of a mounting cavity that allows the receiving skirt 123 to flush, nest, and seat along the reservoir brim In reference to FIGS. 1-4, the religious purification apparatus 1 comprises a plurality of handles 15. The plurality of handles 15 is distributed about the reservoir housing 11. The plurality of handles 15 serves as grasping elements that allows the user to grasp and move the religious purification apparatus 1 at any position.

Although the invention has been explained in relation to its preferred embodiment, it is to be understood that many other possible modifications and variations can be made without departing from the spirit and scope of the invention as hereinafter claimed.

What is claimed is:

1. A religious purification apparatus comprising:

a reservoir housing;

a cap body;

a stool body;

a connection element;

the reservoir housing comprising a reservoir brim, a reservoir base, a reservoir cavity, a reservoir platform, and a holding platform;

the cap body comprising a stool receiving aperture, and a reservoir receiver;

the reservoir brim and the reservoir base being terminally positioned opposite to each other along the reservoir housing;

the reservoir cavity traversing from the reservoir brim to the reservoir base;

the reservoir platform being positioned within the reservoir cavity;

the reservoir platform being connected along the reservoir base, opposite to the reservoir brim;

the holding platform being positioned within the reservoir cavity;

the holding platform being connected along the reservoir brim;

the reservoir receiver traversing along the cap body;

the stool receiving aperture traversing through the cap body;

the reservoir receiver being removably connected along the reservoir brim through the connection element; and the stool body being positioned within the stool receiving aperture, wherein the stool body is configured to seat within the reservoir cavity of the reservoir housing in a retracted configuration.

2. The religious purification apparatus as claimed in claim 1 comprising:

the reservoir housing further comprising a mounting element;

the mounting element partially traversing from the reservoir base to the reservoir brim; and the holding platform being connected along the mounting element.

3. The religious purification apparatus as claimed in claim 1 comprising:

the holding platform comprising a plurality of drainage slots; and the plurality of drainage slots being distributed about the holding platform.

4. The religious purification apparatus as claimed in claim 1 comprising:

the stool body comprising a plurality of first handling apertures; and the plurality of first handling aperture being distributed about the stool body.

5. The religious purification apparatus as claimed in claim 1 comprising:

the cap body comprising a plurality of second handling apertures; and the plurality of second handling apertures being perimetrically distributed about the stool receiving aperture.

6. The religious purification apparatus as claimed in claim 1 comprising:

the stool body comprising a seating platform, and a stool base;

the seating platform being connected adjacent to the stool base; and the stool base being positioned within the stool receiving aperture, wherein the stool body is configured to seat within the reservoir cavity of the reservoir housing in the retracted configuration.

7. The religious purification apparatus as claimed in claim 6 comprising:

the stool body further comprising a platform receiver; and the platform receiver traversing into the stool base, wherein the platform receiver is configured to nest along the reservoir platform in the retracted configuration.

8. The religious purification apparatus as claimed in claim 1 comprising:

the reservoir receiver comprising and a receiving skirt; and the receiving skirt being perimetrically connected along the cap body.

9. The religious purification apparatus as claimed in claim 8 comprising:

the reservoir receiver further comprising a reservoir receiving cavity; and the reservoir receiving cavity partially traversing into the receiver skirt, wherein the reservoir receiving cavity nests along the reservoir brim in the retracted configuration.

10. The religious purification apparatus as claimed in claim 1, wherein the connection element is a magnet style connector.

11. The religious purification apparatus as claimed in claim 1 comprising:

a plurality of handles; and the plurality of handles being distributed about the reservoir housing.

* * * * *